United States Patent [19]

Warncke

[11] Patent Number: 4,498,470

[45] Date of Patent: Feb. 12, 1985

[54] RESPIRATOR HAVING CIRCULATING BREATHING GAS

[75] Inventor: Ernst Warncke, Lubeck, Fed. Rep. of Germany

[73] Assignee: Drägerwerk AG, Fed. Rep. of Germany

[21] Appl. No.: 448,335

[22] Filed: Dec. 9, 1982

[30] Foreign Application Priority Data

Jan. 28, 1982 [DE] Fed. Rep. of Germany ..... 3202638

[51] Int. Cl.[3] ..... A62B 7/04

[52] U.S. Cl. ..... 128/202.26; 128/205.12; 128/204.26; 128/205.11; 128/205.16

[58] Field of Search ..... 128/204.22, 204.26, 128/204.28, 204.29, 205.11, 205.12, 205.15, 205.16, 205.17, 204.21, 204.23

[56] References Cited

U.S. PATENT DOCUMENTS

| | | | |
|---|---|---|---|
| 3,722,510 | 3/1973 | Parker | 128/205.12 |
| 3,837,337 | 9/1974 | La Violette | 128/205.16 |
| 4,031,887 | 6/1977 | Botos et al. | 128/205.12 |
| 4,056,098 | 11/1977 | Michel et al. | 128/204.22 |
| 4,273,120 | 6/1981 | Oswell | 128/205.12 |

FOREIGN PATENT DOCUMENTS

| | | | |
|---|---|---|---|
| 493840 | 9/1977 | Australia | 128/204.22 |
| 1336301 | 7/1963 | France | 128/205.12 |
| 724801 | 2/1955 | United Kingdom | 128/205.16 |

*Primary Examiner*—Henry J. Recla
*Attorney, Agent, or Firm*—McGlew and Tuttle

[57] ABSTRACT

A respirator comprises a respirator which includes a closed circulation circuit for breathing gas which has in any phase of the breathing process a slight overpressure compared to the ambient atmosphere. The excess pressure in the circuit is maintained by a combination of lung controlled amount of air and an amount of oxygen added independent of the oxygen content in the expiration air. Leakages are compensated to maintain proper breathing. The lung controlled amount of equalizing air prevents the possibility of hazardous outflow in case of leakages. The switchable connection is maintained between the compressed air line and the lung control valve with the oxygen line to ensure the supply of proper circulating air even in a failure of the electrical control of the oxygen supply. For the ratio of the two pressure gas supplies to each other it was expedient to select a ratio of air to oxygen of about 1:4. For a 2 hour apparatus, a 1.2 liter bottle with 200 bar filling pressure can be selected for the compressed oxygen, so that an oxygen supply of 240 liters is obtained, and a content of 0.3 liters at 200 bar can be selected for the compressed air bottle, which yields an air supply of 60 liters. The total breathing gas supply is then 300 liters which is sufficient for an operating time of 2 hours.

5 Claims, 2 Drawing Figures

RESPIRATOR HAVING CIRCULATING BREATHING GAS

FIELD AND BACKGROUND OF THE INVENTION

This invention relates in general to respirators and in particular to a new and useful respirator having a closed respiratory gas circulation line.

Respirators, and this is particularly true for apparatus with an open circulation and for respirators with closed circulation described here, should have a slight overpressure, compared to the ambient atmosphere in circulation in each phase of the breathing process. In this case, no ambient air can penetrate e.g. in a leakage of the mask sealing edge, even in the inhalation phase.

The excess pressure in the closed circuit requires, however, in this case an outflow of the relatively small oxygen supply to the outside; high concentrations of $O_2$ could then also become hazardous in fighting fire.

In immersion technology it is necessary to fill up the breathing gas volume by controlling the $O_2$ content, due to the rising ambient pressure.

A known respirator with circulation of the breathing air forms the circulation over a breathing bag, a $CO_2$ binding cartridge, as well as an inhalation and exhalation hose to the face mask and the diver helmet respectively. In this closed circuit, an equalizing gas bottle introduces inert gas over a valve controlled automatically by the pressure when the pressure difference between the breathing bag and the environment rises when the ambient pressure is increased, e.g. in diving, and the breathing gas volume in the breathing bag diminishes by the rising ambient pressure and no longer suffices to fill the lungs. An oxygen bottle supplies oxygen into the breathing bag over a pressure reducer and regulating valve through a line. The control of the oxygen line is effected over an oxygen sensor, arranged in the breathing bag or in the inhalation tracts. The oxygen supply is thus always effected in dependence on the oxygen consumption.

There is no control here of the equalizing gas over an automatic lung for each breath, and no control of a constantly lower overpressure, compared to the ambient pressure. Besides, the equalizing gas, here inert gas, will further reduce the oxygen concentration for breathing, depending on the immersion depth. A complicated control would be required for the equalization (German Pat. No. 1,104,828).

Another known respirator concerns a device for maintaining a predetermined gas mixture or an atmosphere, particularly a device for maintaining and regulating the desired amount of oxygen in a gas mixture to be inhaled.

The breathing gas is conducted in a cycle in which the carbon dioxide is absorbed in a device. The spent oxygen is supplied from a storage tank, in addition an equalizing tank is provided for a neutral gas.

The oxygen is determined over a detector and controlled correspondingly from the storage tank. The valve arrangement comprises a correspondingly controlled valve, as well as a constantly open valve, which permits a continuously predetermined minimum flow. A nuetral gas is supplied from the equalizing tank into the cycle over a valve in the breathing bag working in dependence on the immersion depth.

What has been said above, applies here too. There is no control of the equalizing gas, here of the neutral gas, e.g. oxygen or helium, with the breathing pauses over an automatic lung, but by a utility valve, which introduces so much neutral gas into the breathing bag in dependence on the water pressure that this bag is kept inflated (DE-OS No. 14 34 935).

SUMMARY OF THE INVENTION

The invention provides a respirator with regeneration of the breathing air and an excess pressure in the circuit, and the safety that the oxygen content will not exceed 25% even briefly. The apparatus should be simple in design and in use.

In accordance with the invention, a respirator is provided which comprises a closed respiratory gas circulation line which has a connection to the user such as an oxygen mask. An oxygen regenerator cartridge, a breathing bag and an oxygen supply and an equalizing gas supply are all connected into the circulation line. A lung control valve disposed in the circulation line and connected to the equalizing gas supply regulates the supply of this gas in accordance with the pressure in the circulation line. In addition a spring is biased against the breathing bag in a direction to collapse it so as to maintain the line and the slight overpressure compared to ambient pressure.

In the combination oxygen supply with the compressed air supplied over the breathing passes through the lung controlled valve, as an equalizing gas, the composition of the air behind the breathing bag corresponds to the regular breathing air. The oxygen portion dropped by the breathing is determined by the oxygen sensor. The valve control connected with the electronic limit valve system opens a control valve, so that oxygen flows into the circuit over a constant dosing system. If an air loss occurs during the use of an apparatus by leakages in the oxygen mask, air is introduced through the lung controlled valve from the compressed air bottle. Since the oxygen portion of this air is within the control range of 20 to 25% $O_2$, e.g. the oxygen supply does not go into action, but only during the following expiration, that is, by the oxygen consumption. This combination of a lung controlled air delivery with a sensor controlled oxygen delivery has also the great advantage that, if the electronic system fails, the breathing of the apparatus wearer can be readily maintained over the lung controlled valve. The apparatus wearer notices by its frequent response that the electronic control of the oxygen supply no longer works. Due to the reversing valve arranged between the oxygen line and the compressed air line it is then possible to supply the lung controlled valve from the oxygen bottle with oxygen; so that the apparatus wearer has the full service time for the withdrawal, while the oxygen portion in circulation rises. Besides, any response of the lung controlled valve is a sign of a leakage, that is, an outflow of breathing gas to the outside, which can be eliminated or reduced by tightening the mask bands.

In order not to forget at the start of the use of the apparatus at the beginning to open one or the other bottle, both bottle valves can be coupled by a common actuator, so that both bottle valves are opened at the same time when the actuator is operated. This also ensures a satisfactory supply of breathing gas for the apparatus wearer.

For the ratio of the two pressure gas supplies to each other it was necessary to select a ratio of air to oxygen of about 1:4. For a 2 hour apparatus, a 1.2 liter bottle with 200/bar filling pressure can then be selected for the compressed oxygen, so that the oxygen supply is 240 liter, and for the compressed air bottle a 0.3 liter content at 200 bar can be selected, with an air supply of 60 liters. The total breathing gas supply is then 300 liter, which is sufficient for an operating time of 2 hours.

The ratio of the two supplies to each other results from the following consideration:

For the first filling of the circuit and of the breathing bag respectively, with air, we must figure with about 6 liter. If we anticipate a constant mask leakage of 1% of the breathing air turnover, we obtain a loss of 0.4 liter per minute with a mean air turnover of 40 liter per minute. At 120 minutes, the loss is thus 48 liter. Consequently, there are still 6 liter for possible instantaneous major leakages. In general, however, the leakage will be less than 1%, so that the application of the apparatus is pretty safe.

With regard to the oxygen consumption, we can start over 2 hours from a mean consumption between 1.8 and 2 liter per minute, so that the oxygen supply will also correspond to these ratios.

Accordingly it is an object of the invention to provide an improved respirator which includes a closed circuit having in any phase of the breathing process a slight overpressure as compared to the ambient atmosphere.

A further object of the invention is to provide a respirator which includes a closed circulating line having a regenerative gas cartridge, a breathing bag, an oxygen supply and an equalizing gas supply all connected into the circulation line and including a lung control valve disposed in the circulation line and connected to the equalizing gas supply and being responsive to pressure in the circulation line to regulate the supply of the equalizing gas.

A further object of the invention is to provide a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
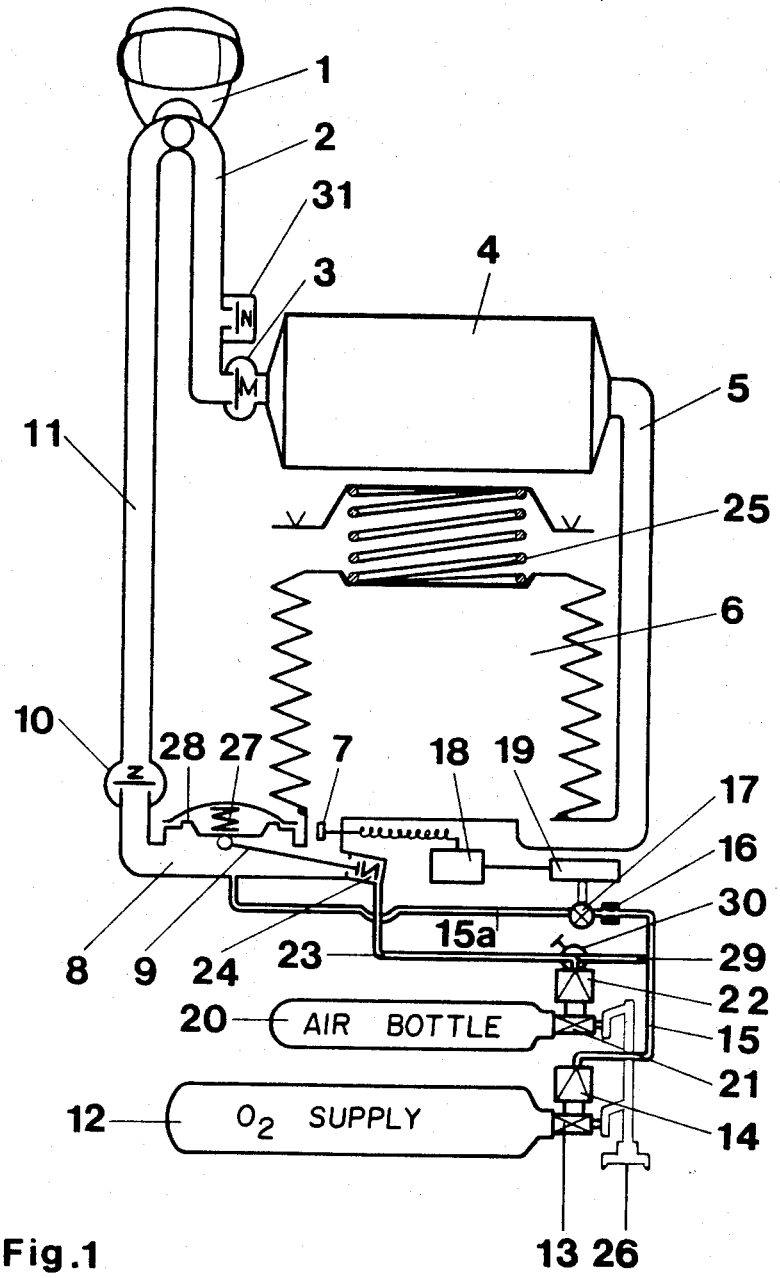
FIG. 1 is a schematic representation of a respirator circuit constructed in accordance with the invention.

Referring to the drawings in particular the invention embodied therein comprises a respirator which includes a respirator gas circulation line 2, which has a connection for the user in the form of an oxygen mask 1. In accordance with the invention an oxygen regenerator cartridge 4, a breathing bag 6, an oxygen supply 12 and an equalizing gas supply 20 are all connected into the circulation line 2 which returns back to the mask in the form of a return line 11.

In accordance with the invention the closed respiratory gas circulation line 2 is maintained at a slight overpressure as compared to the ambient atmosphere and this is accomplished by maintaining a spring biasing on the breathing bag 6 by means of a coil spring 25 in the direction of collapsing of the bag so as to maintain a pressure on the line. This pressure is further controlled by a lung controlled valve 9 which extends across the line 2 in a chamber or space 8 thereof and is moved in accordance with variations of pressure to effect the control of the flow of the equalizing gas from the supply 20. The construction also advantageously includes bottle valves 13 and 21 for the oxygen supply 12 and the equalizing gas 20 and these two supplies include a common actuator 26.

The expiration of air flows from an oxygen mask 1 through hose 2 over a non-return valve 3 to the regenerating cartridge 4 and further over a connecting line 5 into a breathing bag 6. The inspiration air is taken from breathing bag 6 past an oxygen sensor 7 over a space 8 of a lung controlled valve 9, over a non return inspiration valve 10 and a hose 11.

The oxygen is supplied from an oxygen bottle 12 over bottle valve 13, a pressure reducer 14 and over an oxygen line 15 to dosing device 16 arranged in front of or behind a shutoff valve 17.

This temporarily acting dosing device can be arranged, e.g. in the range between 3.5 and 4 liter per minute so that any possible oxygen consumption can be covered when it is constantly connected.

Oxygen sensor 7 regulates over an electronic limit value system 18 a valve control 19, so that shutoff valve 17 with dosing device 16 is shut off temporarily at a lower $O_2$ consumption. The dosed oxygen flows over a line 15*a* into the circuit of the apparatus. Compressed air is supplied from compressed air bottle 20 over bottle valve 21, and a pressure reducer 22 over a compressed air line 23 into a pressure space 24 of lung controlled valve 9 as well, as when this valve is open, into space 8 of the lung controlled valve 9.

At the start of the ventilation, breathing bag 6 is compressed by pressure spring 25 to a reduced volume. As soon as bottle valves 13 and 21 are opened by common actuator 26, air flows over the open lung controlled valve 9 from pressure space 24 into the respiratory circuit.

When oxygen mask 1 has been applied and the circuit is thus sealed from the ambient air, a pressure builds up in the circuit which is determined by the force of pressure spring 25 and a diaphragm spring 27, which acts on a diaphragm 28 of the lung controlled valve 9. It is above the ambient pressure. This ensures that only an air movement from the inside to the outside takes place in leakages. When this pressure has been attained, diaphragm 28 returns into the starting position against the force of diaphragm spring 27, so that the lung controlled valve 9 returns into the rest position, thus interrupting the air supply from the pressure space 24.

When inspiration air is taken from the circuit (by a person inhaling with mask 1 on) and can no longer be covered from the breathing bag volume, the pressure in the circuit drops and the lung controlled valve 9 is opened so long by the pressure of diaphragm spring 27 until the breathing volume is covered. The exhaled air flows then over hose 2, regenerating cartridge 4 and connecting line 5 into breathing bag 6, so that the latter expands against the force of pressure spring 25. A high excess pressure thus builds up in the circuit, which also acts on diaphragm 28. so that the lung controlled valve 9 does not open again. Since the original oxygen portion of the compressed air in the inspiration air has dropped from about 21% by the oxygen consumption during the inspiration to a value below 20%, oxygen sensor 7 gives off a signal to the electronic limit value system 18, so that valve control 19 goes into action and opens shutoff valve 17 of dosing device 16. A constant dosed amount of oxygen thus always flows over line 15*a* into the circuit until a maximum value of 24 or 25% has been attained.

Because of this dosed amount of oxygen always covers the need in the normal case by more or less prolonged opening of the dosing device, there is always sufficient breathing gas contained in the breathing bag for the further breathing to cover the breathing volume. In this normal case, the lung controlled valve 9 will thus not go into action.

But if there is a volume shrinkage by leakage in oxygen mask 1 with a simultaneous higher oxygen consumption, the breathing volume can no longer be covered from breathing bag 6 in one of the following breaths to fill the lungs. Breathing bag 6 is thus emptied, so that pressure spring 25 stretches considerably and the excess pressure in the circuit drops. Since the excess pressure from space 8 of the lung controlled valve 9 on diaphragm 28 also drops, diaphragm spring 27 moves the lung controlled valve 9 in opening direction, so that compressed air flows over compressed air line 23 into the circuit until the breathing volume is covered. This response of the lung controlled valve 9 is thus an audible sign that an inaudible leakage loss exists in the mask. The apparatus wearer can thus tighten the mask bands in such a case.

But if an accident related major leakage occurs at the edge of the mask, air is likewise supplied in the above described manner, so that only air of normal atmosphere composition flows off at the edge of the mask and head burns in the vicinity of a fire due to escaping oxygen are avoided.

Figure 2:
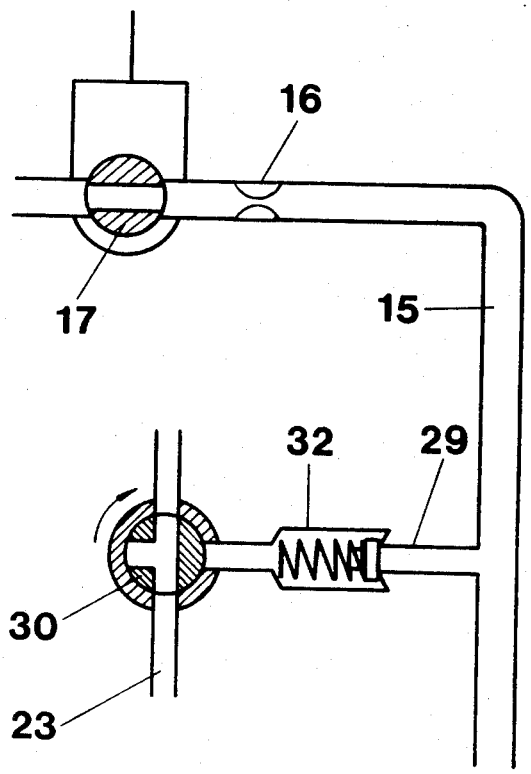
FIG. 2 is an enlarged schematic showing of the connection between the oxygen and the air supply.

Between oxygen line 15 and compressed air line 23 is arranged a connecting line 29 over a manually reversing valve 30. If the electronic dosing control 7,18,19,17 should fail for some reason, the apparatus wearer can switch reversing valve 30 (FIG. 2). By opening connecting line 29 by switching reversing valve 30, the breathing gas is now supplied over the lung controlled valve 9 from oxygen bottle 12, while at the same time line 23 coming from compressed air bottle 20 is blocked. The electronically controlled shutoff valve 17 can be so designed that, when the electronic system fails, the open position is maintained, so that the dosed amount would then flow uninterruptedly.

The apparatus wearer has thus the full withdrawal time available but a higher oxygen portion is established in the circuit, so that a fire fighting operation by the wearer must be stopped.

In connecting line 29 (FIG. 2) can be arranged a non-return valve 32 opening the direction from oxygen line 15 to compressed air line 23, which prevents compressed air from flowing into oxygen line 15.

The circuit can be provided with a safety valve 31, so that compensation with the ambient air is possible in case the excess pressure in the circuit rises too high. A too high pressure increase can occur, for example, when a constant dosage can no longer be shut off by failure of the electronic system, or when the lung controlled valve should get stuck in open position.

While a specific embodiment of the invention has been shown and described in detail to illustrate the application of the principles of the invention, it will be understood that the invention may be embodied otherwise without departing from such principles.

What is claimed is:

1. A respirator comprising:

a closed respiratory gas circulation line having a connection for a user;

a regenerator cartridge in said circulation line for regenerating respiratory gas passing through said cartridge;

a breathing bag connected to said circulation line for receiving and discharging respiratory gas from and to said circulation line;

spring means engaged with said breathing bag for biasing said breathing bag to increase a pressure of respiratory gas in said circulation line above an ambient pressure outside said circulation line;

an oxygen container for containing pressurized oxygen;

an oxygen supply line connected between said oxygen container and said circulation line;

a controllable oxygen valve in said oxygen supply line;

oxygen level control means having an oxygen sensor for sensing an oxygen level in said circulation line and connected to said controllable oxygen valve for controlling said oxygen valve to maintain a selected oxygen level in said circulation line;

equalizing air supply means for supplying pressurized equalizing air to said circulation line when a pressure of respiratory gas in said circulation line falls below a selected pressure level;

an equalizing air supply line connected between said equalizing air supply means and said circulation line for carrying pressurized equalizing air to said circulation line;

lung-controlled valve means connected to said equalizing air supply line and associated with said circulation line for opening said equalizing air supply line when pressure in said circulating line falls below said selected pressure level;

said equalizing air supply means having a capacity for supplying pressurized equalizing air which is less than a capacity of said oxygen container for containing pressurized oxygen;

said supply valve being connected to said oxygen container for opening and closing said oxygen container, said equalizing air supply means comprising a compressed air container, a second supply valve connected to said compressed air container for opening and closing said compressed air container, and a common actuator connected to said first and second supply valves for opening and closing said first and second supply valves together; and a connection line connected between said oxygen supply line and said equalizing air supply line, a selector valve connected to said connecting line and equalizing air supply line and having a first position for connecting said equalizing air supply means to said circulation line while disconnecting said equalizing air supply line from said oxygen supply line and a second position connecting said equalizing air supply means to said equalizing air supply line while disconnecting said equalizing air supply means from said circulation line.

2. A respirator according to claim 1, including a one-way valve connected in said connecting line for permitting passage of oxygen from said oxygen supply to said selector valve while preventing passage of compressed air from said equalizing air supply line to said oxygen supply line.

3. A respirator according to claim 2, including a first check valve in said circulation line for permitting passage of respiratory gas only from said connection for a user to said regenerator cartridge and a second check valve in said circulation line between said breathing bag and said connection for a user for permitting passage of respiratory gas only from said breathing bag to said connection for a user.

4. A respirator according to claim 3, wherein said spring means comprises a spring engaged with said breathing bag biasing said breathing bag in a direction to reduce a volume of said breathing bag.

5. A respirator according to claim 4, wherein said oxygen sensor is positioned in said circulation line between said breathing bag and a location of association between said lung-control valve means and said circulation line for sensing oxygen level in respiratory gas leaving said breathing bag.

* * * * *